US008178059B2

(12) United States Patent
Sims

(10) Patent No.: US 8,178,059 B2
(45) Date of Patent: May 15, 2012

(54) SYSTEMS AND METHODS FOR SUPPLYING CHLORINE TO AND RECOVERING CHLORINE FROM A POLYSILICON PLANT

(75) Inventor: James T. Sims, Vancouver, WA (US)

(73) Assignee: CH2M HILL Engineers, Inc., Englewood, CO (US)

( * ) Notice: Subject to any disclaimer, the term of this patent is extended or adjusted under 35 U.S.C. 154(b) by 769 days.

(21) Appl. No.: 12/329,471

(22) Filed: Dec. 5, 2008

(65) Prior Publication Data

US 2009/0145770 A1 Jun. 11, 2009

Related U.S. Application Data

(60) Provisional application No. 60/992,674, filed on Dec. 5, 2007.

(51) Int. Cl.
*B01J 19/00* (2006.01)
*C25B 1/00* (2006.01)
*C01B 7/01* (2006.01)

(52) U.S. Cl. ..... 422/608; 422/620; 422/630; 422/234; 204/252; 204/266

(58) Field of Classification Search ..... 422/608, 422/620, 630, 234; 204/252, 266; 423/348, 423/487; 205/620
See application file for complete search history.

(56) References Cited

U.S. PATENT DOCUMENTS

| | | | | |
|---|---|---|---|---|
| 2,750,002 | A | 6/1956 | Hooker et al. | |
| 3,077,082 | A | 2/1963 | Adam et al. | |
| 4,105,515 | A | 8/1978 | Ogawa et al. | |
| 4,180,547 | A | 12/1979 | Chirico | |
| 4,213,937 | A | 7/1980 | Padovani et al. | |
| 4,214,957 | A * | 7/1980 | Ogawa et al. | 205/516 |
| 4,443,307 | A * | 4/1984 | Moore et al. | 205/536 |
| 2005/0269266 | A1 | 12/2005 | Twardowski et al. | |

OTHER PUBLICATIONS

International Search Report dated Feb. 19, 2009, PCT/US2008/085744, including Written Opinion, 8 pages.

* cited by examiner

*Primary Examiner* — Jennifer A Leung
(74) *Attorney, Agent, or Firm* — Dorsey & Whitney LLP

(57) ABSTRACT

A system for supplying chlorine to and recovering chlorine from a polysilicon plant may include a brine treatment system, at least one membrane cell, a chlorine drying system, a chlorine compression system, a hydrogen drying system, a hydrogen compression system, a hydrogen chloride synthesis/desorption system, a hydrogen chloride liquefaction system, a liquefied hydrogen chloride storage system, a hydrogen chloride vaporizer, and a waste conversion and filtration system. These systems may be operatively joined to generate hydrogen chloride gas for delivery to the polysilicon plant. A method for supplying chlorine to the polysilicon plant may include generating hydrogen gas and chlorine gas from recovered and raw salt, converting at least a portion of the hydrogen gas and at least a portion of the chlorine gas to hydrogen chloride, passing the hydrogen chloride through a cryogenic column, vaporizing the hydrogen chloride, and providing the vaporized hydrogen chloride to the polysilicon plant.

15 Claims, 9 Drawing Sheets

200
NaCl
NaOH
FLOC
CO2
NaOH
HCl
NaOH
210
220
1
WATER
2
BRINE PREP
PRIMARY BRINE TREATMENT
SECONDARY BRINE TREATMENT
4
HCl
215
HCl
230
PURE BRINE
SULFATE REMOVAL
CHLORATE REMOVAL
3
240
225
BRINE DECHLORINATION
235
ELECTROLYSIS SYSTEM
(A)
(B)
11
250
VENT
DILUTE CAUSTIC
BLEACH SCRUBBER SYSTEM
(C)
5
DILUTE NaOH INTERNAL USAGE
245
STARTUP/ SHUTDOWN CHLORENE
CAUSTIC EVAPORATION
50% NaOH INTERNAL USAGE
BLEACH
(D)

260
270
200
7
CHLORINE COOLING/DRYING
CHLORINE COMPRESSION
6
HYDROGEN COOLING/DRYING
HYDROGEN COMPRESSING
265
275
HCl ABSORBER
H2
12
SCRUBBER
9
8
HCl LIQUEFACATION SYSTEM
HCl SYNTHESIS/ DESORPTION SYSTEM
255
280
(A)
(B)
HCL VAPORIZER
290
285
295
10
LIQUEFIED HYDROGEN CHLORIDE STORAGE SYSTEM
HCl ABSORBER
36% HCl INTERNAL USAGE
(C)
205
NaOH
105
Si WASTE
PFD-1 WASTE CONVERSION AND FILTRATION SYSTEM
POLYSILICON PLANT
(D)

SYSTEMS AND METHODS FOR SUPPLYING CHLORINE TO AND RECOVERING CHLORINE FROM A POLYSILICON PLANT

CROSS-REFERENCE TO RELATED APPLICATIONS

This application claims the benefit under 35 U.S.C. §119 (e) to U.S. Provisional Application No. 60/992,674, entitled "Systems and Methods for Supplying Chlorine to a Polysilicon Plant" and filed on Dec. 5, 2007, the entire disclosure of which is hereby incorporated by reference herein in its entirety.

FIELD OF INVENTION

The present invention generally relates to methods and systems for supplying and recovering chlorine, and more specifically to methods and systems for forming anhydrous chlorine, which can be used to generate hydrogen chloride gas feed for use in a polysilicon plant, and for recovering chlorine from waste streams generated within the polysilicon plant.

BACKGROUND

Polysilicon is a material, which may be used in the manufacture of solar panels. Polysilicon production has grown tremendously over the last few years due to the increasing costs associated with energy production. Many state and local governments have mandated that a certain percentage of the energy produced within their respective jurisdictions be from a renewable source. Electricity generated via solar panels is classified as a renewable energy source in these regulations. The U.S. federal government has offered extensive tax credits to promote investment into polysilicon and solar panel production.

Along with other compounds and materials, polysilicon production requires anhydrous hydrogen chloride gas, which can be generated by combining chlorine and hydrogen. More particularly, typically chlorine and hydrogen are combined in a polysilicon plant to generate anhydrous hydrogen chloride gas. This hydrogen chloride gas, along with metallurgical-grade silicon, is then fed to a process plant, where polysilicon and other chemicals are generated. Waste streams, which need to be properly disposed, are typically generated during this process. Some of these waste streams include chlorine containing compounds.

In some parts of the world, hydrogen chloride and chlorine may be relatively difficult to obtain. Further, transporting hydrogen chloride and chlorine may raise cost, permitting, environmental, and/or health issues. For example, shipping rates for chlorine have nearly tripled over the last few years. Further, U.S. Department of Transportation and other security regulations that require dedicated trains, secure storage areas, and restrictions on shipping toxic inhalation hazard (TIH) chemicals, which include hydrogen chloride and chlorine, through certain areas are impacting the ability to ship these chemicals. Yet further, numerous hydrogen chloride and chlorine production plants in Europe and North America are slated for closure because of environmental regulations, thus further limiting potential chemical supply sources.

BRIEF SUMMARY

One embodiment of the present invention may take the form of a system for supplying chlorine to and recovering chlorine from a polysilicon plant. The system may include a brine treatment system, at least one membrane cell, a chlorine drying system, a chlorine compression system, a hydrogen drying system, a hydrogen compression system, a hydrogen chloride synthesis/desorption system, a hydrogen chloride liquefaction system, a liquefied hydrogen chloride storage system and a hydrogen chloride vaporizer. The at least one membrane cell may be operatively associated with the brine treatment system. The chlorine drying system may be operatively associated with the at least one membrane cell. The chlorine compression system may be operatively associated with the chlorine drying system. The hydrogen drying system may be operatively associated with the at least one membrane cell. The hydrogen compression system may be operatively associated with the hydrogen drying system. The hydrogen chloride synthesis/desorption system may be operatively associated with the chlorine compression system and the hydrogen compression system. The hydrogen chloride liquefaction system may be operatively associated with hydrogen chloride synthesis/desorption system. The hydrogen chloride storage system may be operatively associated with the hydrogen chloride liquefaction system. The hydrogen chloride vaporizer may be operatively associated with at least one of the liquefied hydrogen chloride storage system and the hydrogen chloride liquefaction system. The hydrogen chloride vaporizer may be in fluid communication with the reactor feed delivery system located within the polysilicon plant.

Another embodiment of the present invention may take the form of a method of supplying chlorine to a polysilicon plant. The method may include generating hydrogen gas and chlorine gas from salt, converting at least a portion of the hydrogen gas and at least a portion of the chlorine gas to hydrogen chloride, passing the hydrogen chloride through a cryogenic column, vaporizing the hydrogen chloride, and providing the vaporized hydrogen chloride to the polysilicon plant.

DETAILED DESCRIPTION

Figure 1:
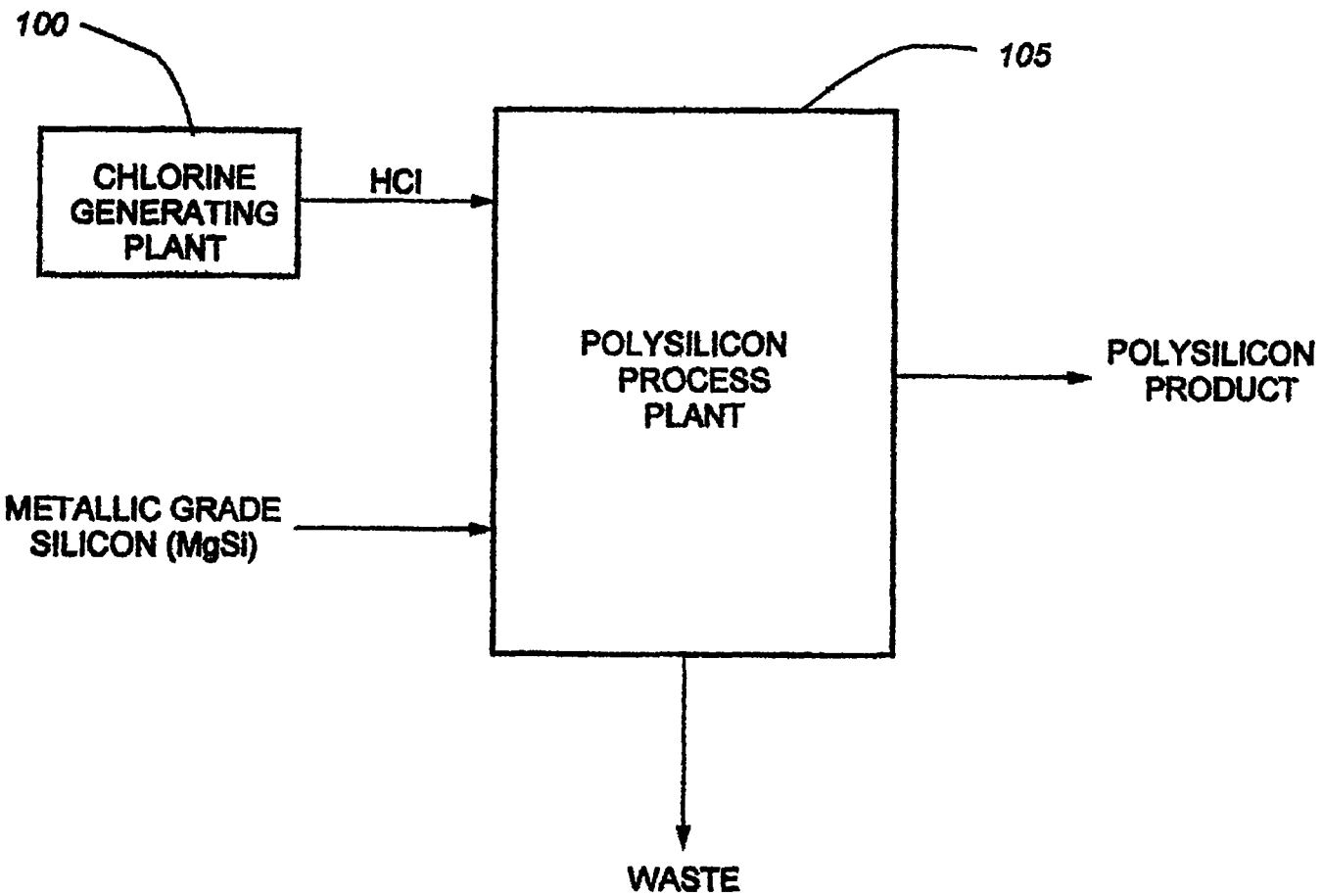
FIG. 1 depicts a schematic view of a chlorine generating plant positioned on a site proximate a polysilicon process plant.

Described herein are methods and systems for providing chlorine to a polysilicon plant, which may include converting, recovering, and purifying chlorine for use in a polysilicon plant. With reference to FIG. 1, these methods and systems may include providing a Chlor-Alkali or other chlorine generating plant 100 or system proximate to the polysilicon plant 105, thus forming an integrated Chlor-Alkali and polysilicon plant. The chlorine generating plant 100 may produce anhydrous hydrogen chloride or chlorine, which may then be piped or otherwise delivered to a polysilicon plant 105 located on the same site as the chlorine generating plant 100 or system.

In some embodiments, the chlorine generating method and system may include chlorine and hydrogen streams, which may be dried, compressed and delivered to a hydrogen chloride synthesis unit. The chlorine product produced in the hydrogen chloride synthesis unit may then be processed through a cryogenic column to remove trace gases. The chlorine product, which may be liquefied anhydrous hydrogen chloride, may then be vaporized and delivered to the polysilicon plant 105. A side stream of hydrogen chloride may be delivered to an absorber to produce aqueous hydrochloric acid. This aqueous hydrochloric acid may be delivered to the chlorine generating system for re-use, may delivered to a water treatment system for use in treating fresh water or wastewater, or may be delivered to other devices or systems that require hydrochloric acid.

In some embodiments, the method and system may include cleaning a waste stream from the polysilicon plant 105 and recycling one or more key raw materials back into the polysilicon plant 105. The recovery of this waste stream may allow current and future polysilicon plants to greatly reduce the disposal of chloride-rich brine streams. The reduced environmental footprint of the polysilicon plant 105 will not only allow for obtaining operating permits for these plants 105, but also allow these plants 105 to be constructed in nearly any location. Previously, polysilicon plants could only be built where a very large, brine stream could be disposed of easily.

In some embodiments, the method and system may include converting a substantial portion, up to the entire amount, of recovered chlorine into hydrochloric acid. Such conversion allows for the storage of a low hazard hydrochloric acid rather than highly hazardous liquefied chlorine or hydrogen chloride gas. In such embodiments, the hydrochloric acid may be distilled (or desorbed) to produce a wet hydrogen chloride gas, which can then be dried and compressed for delivery to a reactor feed delivery system located in a polysilicon plant.

Figure 2A:
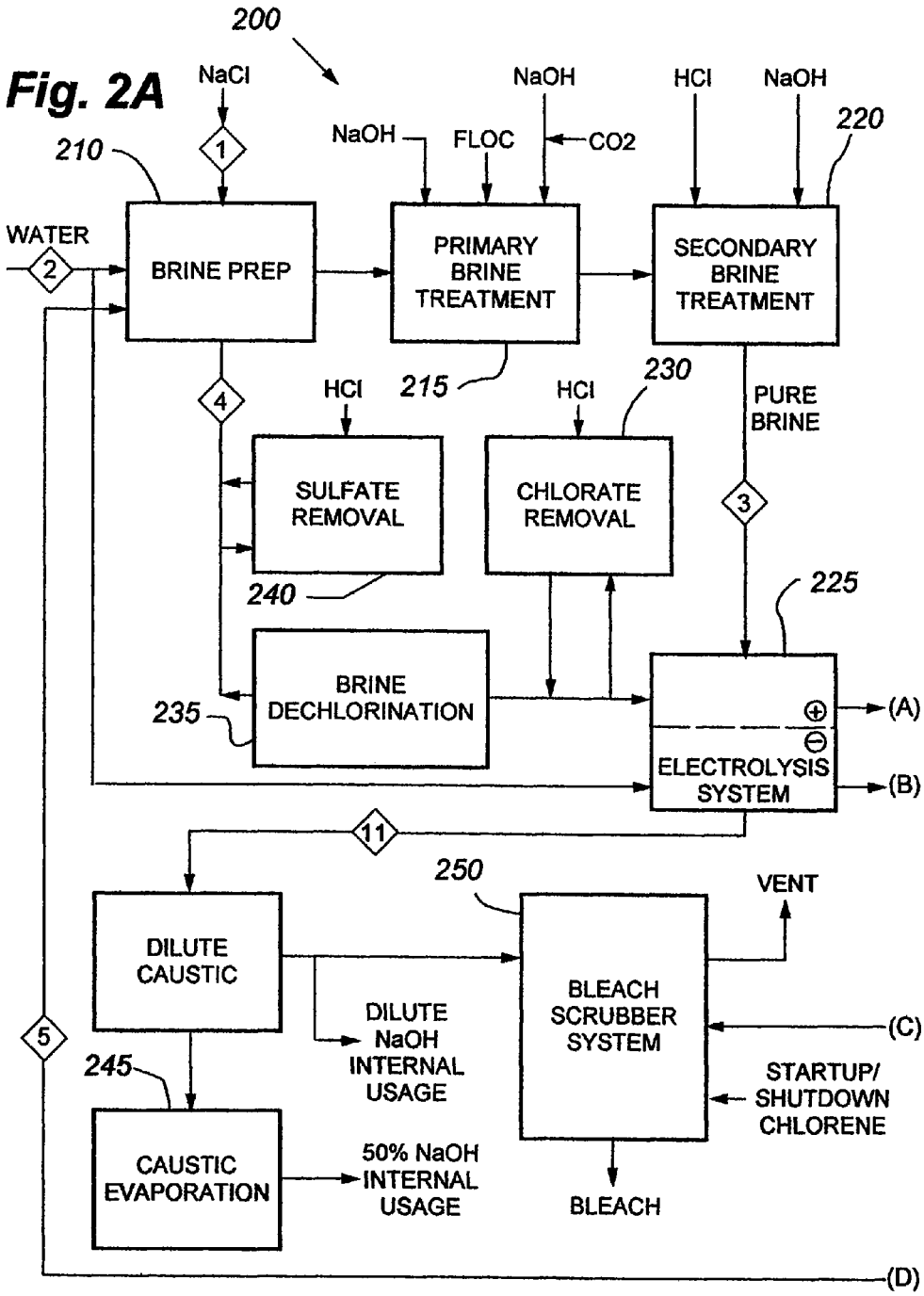
FIG. 2A depicts a schematic view of a first portion of an example of a system for supplying chlorine to and recovering chlorine from a polysilicon plant.
Figure 2B:
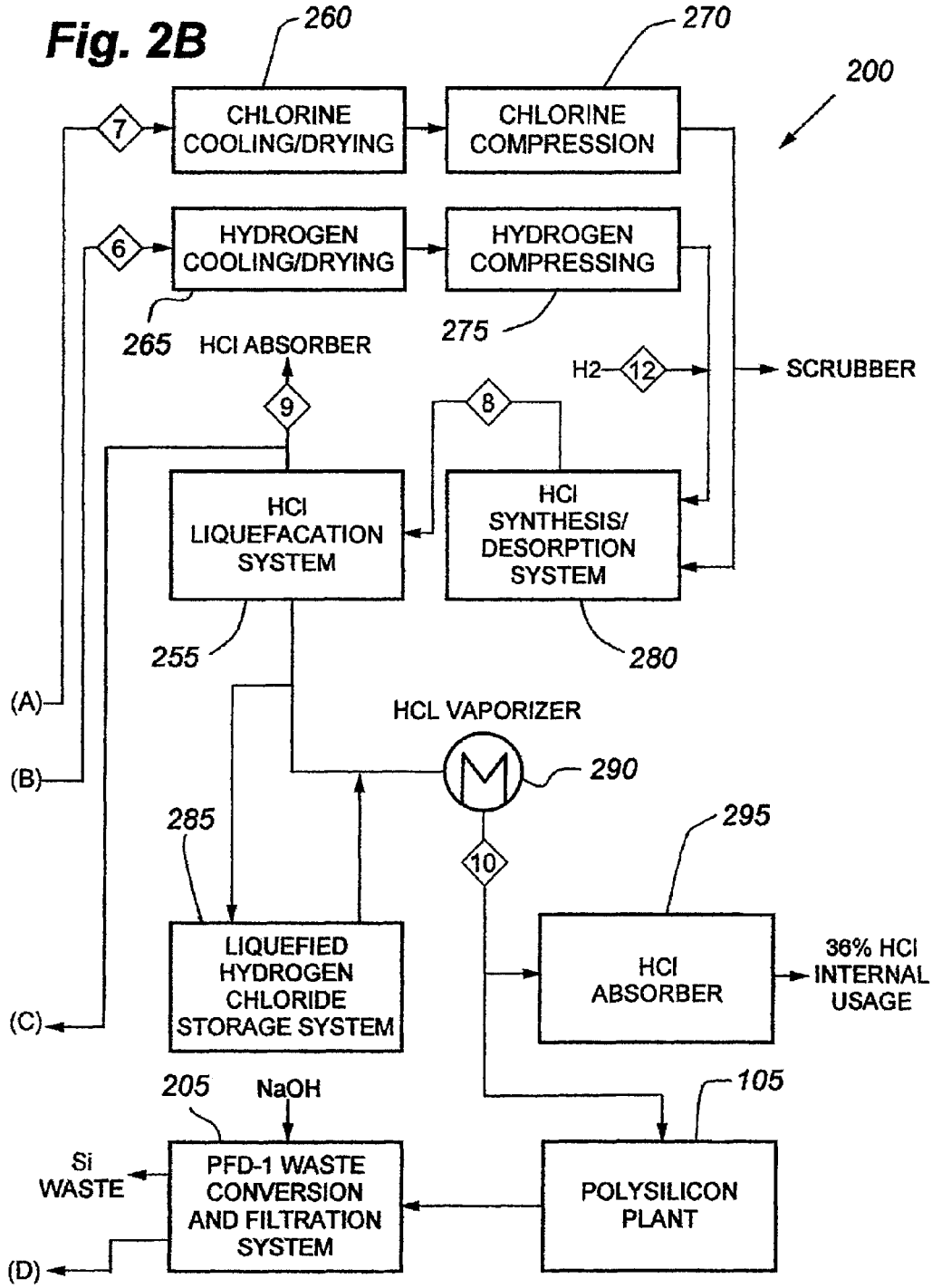
FIG. 2B depicts a schematic view of a second portion of the example of a system for supplying chlorine to and recovering chlorine from a polysilicon plant.

FIGS. 2A and 2B shows a schematic diagram of an example of a system 200 for supplying chlorine to a polysilicon plant 105 and for recovering chlorine, which may be in the form of salt, from the wastes generated within the polysilicon plant 105. The system may include one or more of the following stages, systems or units: a waste conversion and filtration system 205, a brine preparation stage or system 210, a primary brine treatment stage or system 215, a secondary brine treatment stage or system 220, an electrolysis system 225, a chlorate removal stage or system 230, a brine dechlorination stage or system 235, a sulfate removal stage or system 240, a caustic evaporation stage or system 245, a bleach scrubbing stage or system 250, a hydrogen chloride liquefaction system 255, a chlorine cooling or drying stage or system 260, a hydrogen cooling or drying stage or system 265, a chlorine compression stage or system 270, a hydrogen compression stage or system 275, a hydrogen chloride synthesis/desorption stage or system 280, a liquefied hydrogen chloride storage system 285, a hydrogen chloride vaporizer 290 and a hydrogen chloride absorber 295.

Overview of Chlorine Supply and Recovery System

In the brine preparation stage or system 210, raw brine may be formed using water and salt. Salt recovered from waste generated by processes in the polysilicon plant 105 may also be used to form the raw brine. The raw brine may be delivered to the primary brine treatment stage or system 215 for removal of impurities that occur in recovered and raw salt using chemicals, such as caustic soda and sodium carbonate. These chemicals may form insoluble complexes with at least some of the impurities, commonly known as "floc", which may be settled in a clarifier. The resulting clarified brine may be filtered to remove at least some insoluble complexes that remain suspended in the solution.

Because of relatively small pore size in electrolytic membranes used in the electrolysis system 225, the treated, clarified and filtered brine may require further purification so that the cell membrane life is not significantly shortened due to pluggage. Further purification of the brine may be accomplished by feeding the brine from the primary brine treatment system 215 to the secondary brine treatment system 220. In the secondary brine treatment system 220, a secondary brine filtration system and a chelating resin may be used to remove additional cations and anions from the brine, thus producing ultra purified brine.

The ultra purified brine may be fed from the secondary brine treatment system 220 to the electrolysis system 225. The electrolysis system 225 may include a cell room, which houses one or more electrolytic membrane cells. At least a portion of the salts in the brine may be changed in the electrolytic membrane cells to form chlorine gas, caustic soda, and hydrogen gas, and another portion of the brine, which may be referred to as depleted brine, may re-circulated back to the brine preparation system 210 for resaturation. Prior to re-circulating the depleted brine to the brine preparation system 210, the depleted brine may be treated to remove residual chlorine to avoid damaging the chelating resin in the secondary brine treatment stage 220. Also, the depleted brine may be treated to remove the sodium sulfate ions since sulfate is an impurity in the raw salt and may continue to increase in concentration in the brine streams, thus potentially adversely affecting cell performance unless removed prior to re-using the depleted brine upstream of the cell room. The depleted brine may be resaturated with raw salt in the brine preparation stage or system 210.

Returning to the electrolysis system 225, a rectified DC current may be applied to the electrolytic membrane cells. As the current passes through the cells, at least some of the salt molecules contained within the brine are broken apart. At anodes of the electrolytic membrane cells, chlorine ions combine to form chlorine gas. At cathodes of the electrolytic membrane cells, sodium ions react with water to produce sodium hydroxide, which is commonly called caustic soda, and hydrogen gas. Demineralized water may be added to cathode chambers of the electrolytic member cells to control the caustic soda concentration. The desired concentration of the caustic soda may be approximately 32 percent.

The hydrogen gas generated at the cathode may pass through the dilute caustic to exit the electrolytic membrane cell. Because the electrolysis may be carried out at a relatively high temperature (approximately 80 to 90° C.), a considerable amount of water may be contained in the hydrogen gas. The hydrogen gas may be cooled, dried, and compressed. The hydrogen may be used to produce hydrochloric acid, as makeup hydrogen in the polysilicon plant, as a fuel source in a boiler, or as a reactant in other chemical reactions.

Chlorine gas generated at the anode passes through the depleted brine. The chlorine gas may exit the electrolytic membrane cell saturated with water. Wet chlorine tends to be corrosive. Thus, special materials of construction may be required for long equipment life. The chlorine gas may be cooled and dried by passing it through a solution of concentrated sulfuric acid. The chlorine gas may be compressed and liquefied. Liquefaction may be done using a refrigeration unit.

The dilute caustic stream that exits the electrolytic membrane cell may be fed to the caustic evaporation system 245 to produce approximately 50 percent caustic soda. The concentrated caustic soda exiting the caustic evaporation system 245 may contain less than approximately 200 ppm NaCl and less than approximately 7 ppm iron. The dilute caustic soda may also be used to neutralize the chlorine-containing waste compounds from the polysilicon plant 105 in the waste conversion and filtration system 205.

To meet relatively stringent specifications for moisture in the chlorine produced, the wet chlorine stream may be processed through a drying and mist elimination system, such as the chlorine cooling/drying system 260. The dry chlorine may then be further processed through the chlorine compression system 270 and a chlorine liquefaction system to produce a greater than approximately 99 percent liquid chlorine product.

The hydrogen and chlorine generated in the electrolytic membrane cells may be combined to produce anhydrous hydrogen chloride. The systems that could be involved in this hydrogen chloride process are the hydrogen chloride synthesis/desorption system 280, the hydrogen chloride liquefaction system 255 (e.g., a cryogenic column), the liquefied hydrogen chloride storage system 285, and the hydrogen chloride vaporizer 290. The anhydrous hydrogen chloride may be fed to a reactor feed delivery system or other system in the polysilicon plant 105 for use in generating polysilicon.

Waste streams from the polysilicon plant 105 may be fed to the waste conversion and filtration system 205. The waste conversion and filtration system 205 may include filters to remove solids, carbon beds for organic removal, evaporation systems to concentrate the recovered brine, and salt saturators to dissolve the raw salt in the salt recovery stream. The waste conversion and filtration system 205 may include other treatment systems as necessary to treat impurities that may be present in the polysilicon plant waste streams.

Each of the above-mentioned systems and some of the other systems and components that may be used in a system for supplying chlorine to a polysilicon plant and for recovering chlorine from polysilicon waste streams are described in more detail below.

Waste Conversion and Filtration System

The waste conversion and filtration system or stage 205 may include a number of units and operations to process various liquid and gas waste streams received from the polysilicon plant 105. For example, the waste conversion and filtration system 205 could implement a variety of systems, such as multiple stirred reactors (parallel or in series) with dilute caustic addition, to raise the pH (to neutralize) of these streams to around a pH of 9 so that the metal chlorides are converted to metal oxide ions and sodium salts. The resultant brine stream may then be filtered in one or more stages to remove the insoluble metal oxides from the brine stream. The pH of the brine stream may be adjusted and various filter aids, such a flocculating chemicals, may be employed to assist in the removal of these metal oxide ions.

The polysilicon plant 105 produces a variety of liquid and gaseous waste streams. The liquid waste streams contain various chlorosilanes, for example trichlorosilane, silicon tetrachloride, and other silicon chlorides. The liquid waste streams also contain metal chlorides, such as aluminum chloride, ferric chloride, and other metal salts, which result from impurities in the metallurgical grade silicon feed and leeching of the piping equipment in the plant.

Figure 3A:
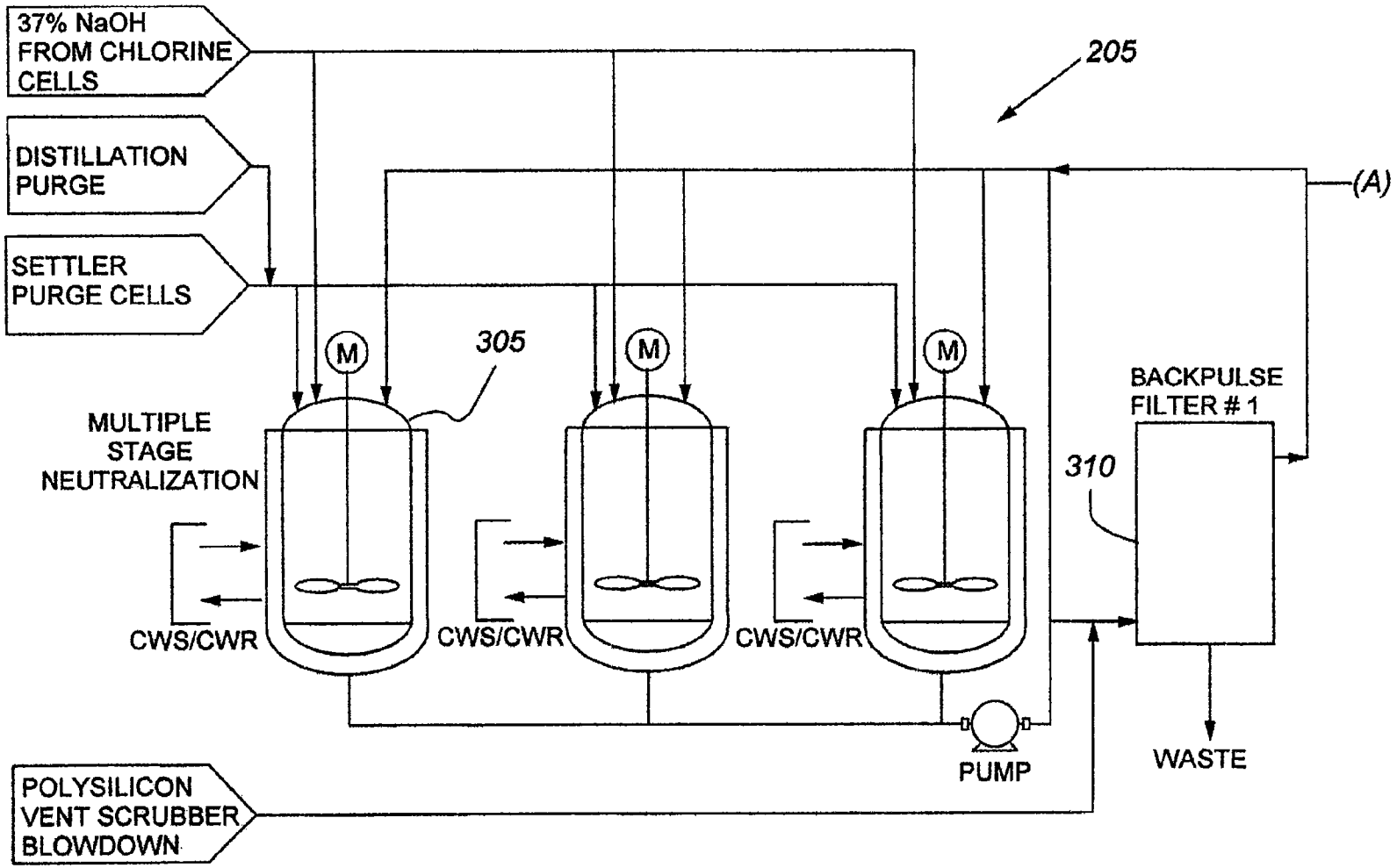
FIG. 3A depicts a schematic view of a first portion of an example of a waste conversion and filtration system that may be used in the chlorine supply and recovery system shown in FIGS. 2A and 2B.
Figure 3B:
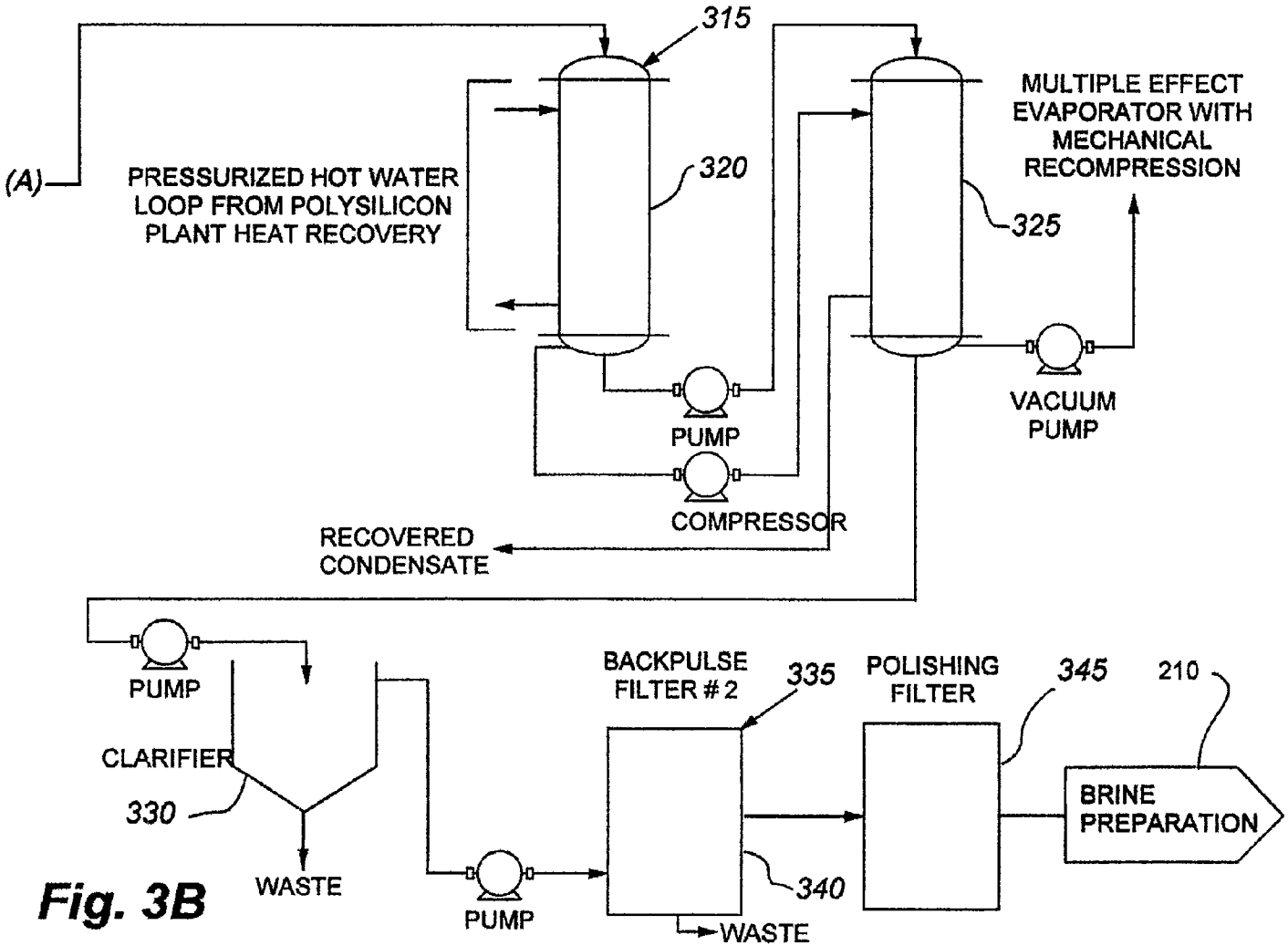
FIG. 3B depicts a schematic view of a second portion of the example of a waste conversion and filtration system that may be used in the chlorine supply and recovery system show in FIGS. 2A and 2B.

One potential method of converting the various silicon and metal chloride wastes to sodium salts is by neutralization with an alkali chemical. To recover the chlorine within these chemical compounds, sodium hydroxide is used to convert these chlorine-containing compounds to metal oxide salts and sodium chloride. With reference to FIGS. 3A and 3B, this neutralization may be done in one or more batch tanks or scrubbers 305. Waste or vent hydrogen chloride gas may be directed to these neutralization systems, where the conversion products are water and sodium chloride.

Prior to delivery to the brine preparation system 210, the recovered salt solution could be processed through a filter for solids removal, an evaporation unit for water reduction, and a carbon bed for any trace impurities absorption. For example, with continued reference to FIGS. 3A and 3B, the resulting metal and sodium chloride ion containing stream, commonly referred to as "brine", from the neutralization tanks or scrubbers 305 may be fed to a filtration system 310, where the insoluble, crystallized metal chloride ions are removed by various filtration methods, such as back pulse filtration, precoat filter, down flow sand bed, or the like. Multiple stages of decreasing mesh size may be necessary for effective removal of these metal ions from the brine. The sodium chloride ions, which are soluble, pass through the filtration steps.

A saturated brine solution could be used for the efficient removal of metal ions and may be required as a feed stream for the electrolytic cells. Thus, a brine concentration system may be added to the waste conversion and filtration system 205. The brine stream may be concentrated using a multiple effect evaporator, which could include up to four effects. Accordingly, after initial filtration in the filtration system 310, such as the backpulse filter shown in FIG. 3A, the recovered salt may be passed through an evaporation system 315, such as the multiple effect evaporator with mechanical recompression system shown in FIG. 3B, to reduce the water content of the recovered salt solution. Residual low grade heat from the polysilicon plant deposition and conversion reactors may be used to heat the first effect 320, and vapor generated in the first effect may be used to heat the second effect 325.

After evaporation, the recovered salt solution may be fed to a clarification system 330, such as the clarifier shown in FIG. 3B, to settle crystallized metal salts that are difficult to filter. After clarification, the recovered salt solution (i.e., the brine) may be fed through another filtration system 335, such as the second backpulse filter 340 and polishing filter 345 shown in FIG. 3B, to further remove any residual metal salts and other contaminants within the recovered salt solution.

Brine Preparation System

The brine preparation treatment stage or system 210 produces brine feed for delivery to the primary brine treatment stage or system 215. The brine preparation treatment stage or system 210 may include a basin for combining raw salt with a liquid to form a raw brine. The raw salt may transported to the site via barges, ships or other transportation systems. The liquid used to dissolve the salt may be recycled dechlorinated depleted brine, fresh de-mineralized water, recycled brine from the desulfonation unit, recovered salt solution from the polysilicon process, or a combination thereof.

Primary Brine Treatment System

The raw brine may be pumped to the primary brine treatment stage or system 215 via pipes or other suitable fluid conveyance systems. To limit the potential for re-crystallization of the salt in the piping, basins, vessels and other conveyance systems and tanks of the system 200, the brine concentration may be controlled to have a salt concentration of no greater than approximately 320-325 grams NaCl per liter (gpl).

Figure 4:
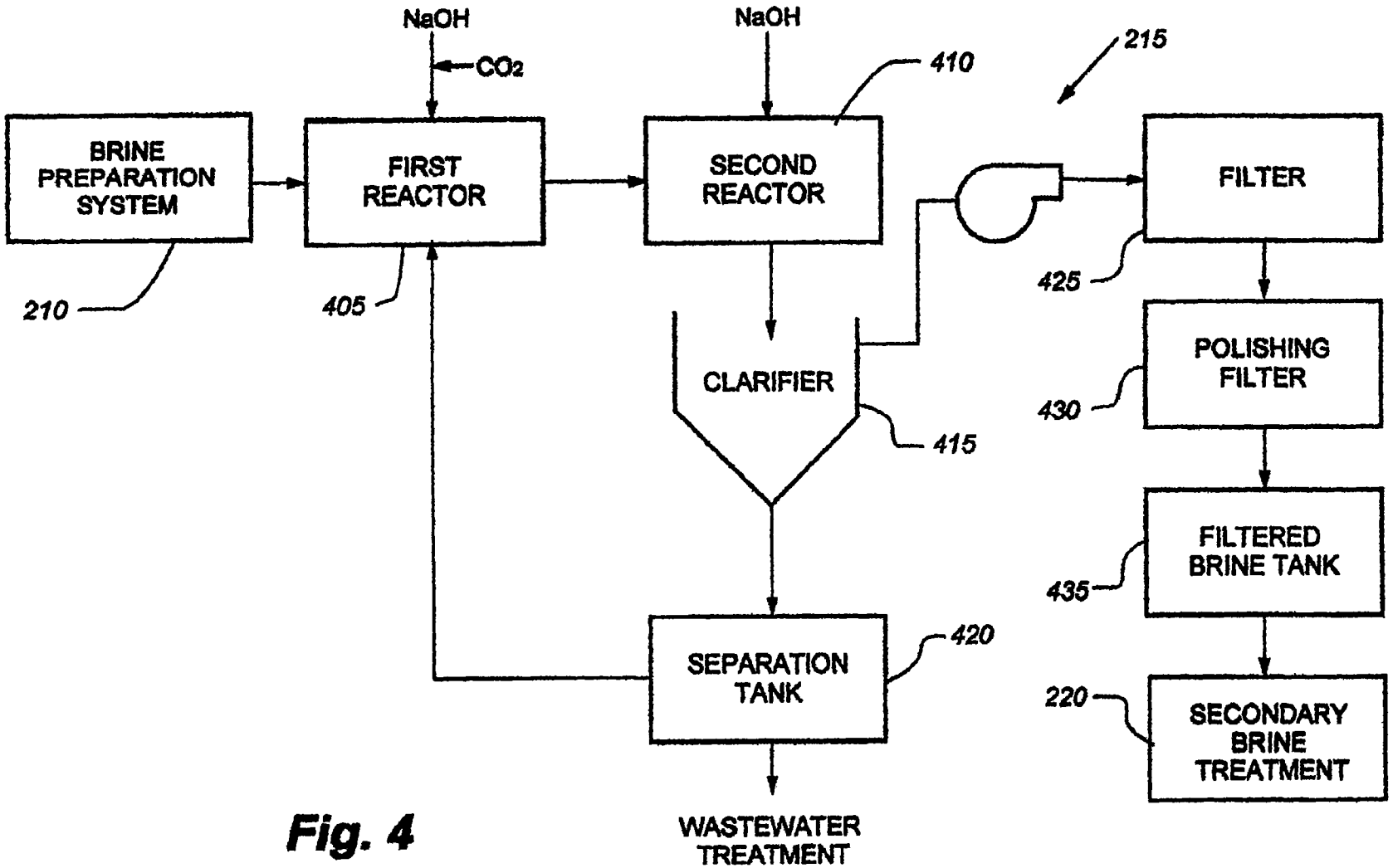
FIG. 4 depicts a schematic view of an example of a primary brine treatment system that may be used in the chlorine supply and recovery system shown in FIGS. 2A and 2B.

With reference to FIG. 4, one or more treatment reactors may be employed in the primary brine treatment system. In a first reactor 405, raw brine may be treated with soda ash (sodium carbonate) or similar chemicals to complex and to precipitate calcium ions contained within brine as calcium carbonate. The brine may then be delivered to a second reactor 410 via pipes or any other suitable fluid conveyance system. In the second reactor 410, caustic soda may be added to complex and precipitate the magnesium ions within the brine as magnesium hydroxide. The magnesium floc may be delicate and fragile. Iron contained within the brine may be removed in the second reactor 410 as a ferric hydroxide. The denser ferric hydroxide and calcium carbonate flocs may be used to help settle the relatively light magnesium hydroxide precipitate. If desired, other flocculants and chemicals, such as calcium chloride, may be added to assist the reaction and to increase settling rates. Other trace metal oxide ions will react in a manner similar to calcium, magnesium, or iron.

Following carbonate and caustic treatment, the brine solution containing the floc may flow by gravity via pipes or other suitable fluid conveyance systems to a clarifier 415. The precipitates are allowed to settle and collect at the bottom of the clarifier 415. A rake may be used to move the settled participates (brine mud) to the sludge discharge port of the clarifier 415, where the mud may be pumped to a separation tank 420. After thickening, the mud may be pumped to a wastewater treatment plant. The supernatant from the separation tank 420 may be returned to the brine reactors 405, 410.

The clear brine overflows the clarifier 415 and may be pumped to a primary brine filter 425, such as a back pulse filter, a pre-coat filter, down flow sand bed, or the like, to remove additional suspended solids. The filtered brine may be pumped to a pre-coat polishing filter 430 to remove yet more suspended solids, which could use cellulose or other solid material to coat the filter screens to provide a higher efficiency of particulate removal. A filtered brine tank 435 may store the filtered brine prior to delivery to the secondary brine treatment stage 220.

Secondary Brine Treatment System

Figure 5:
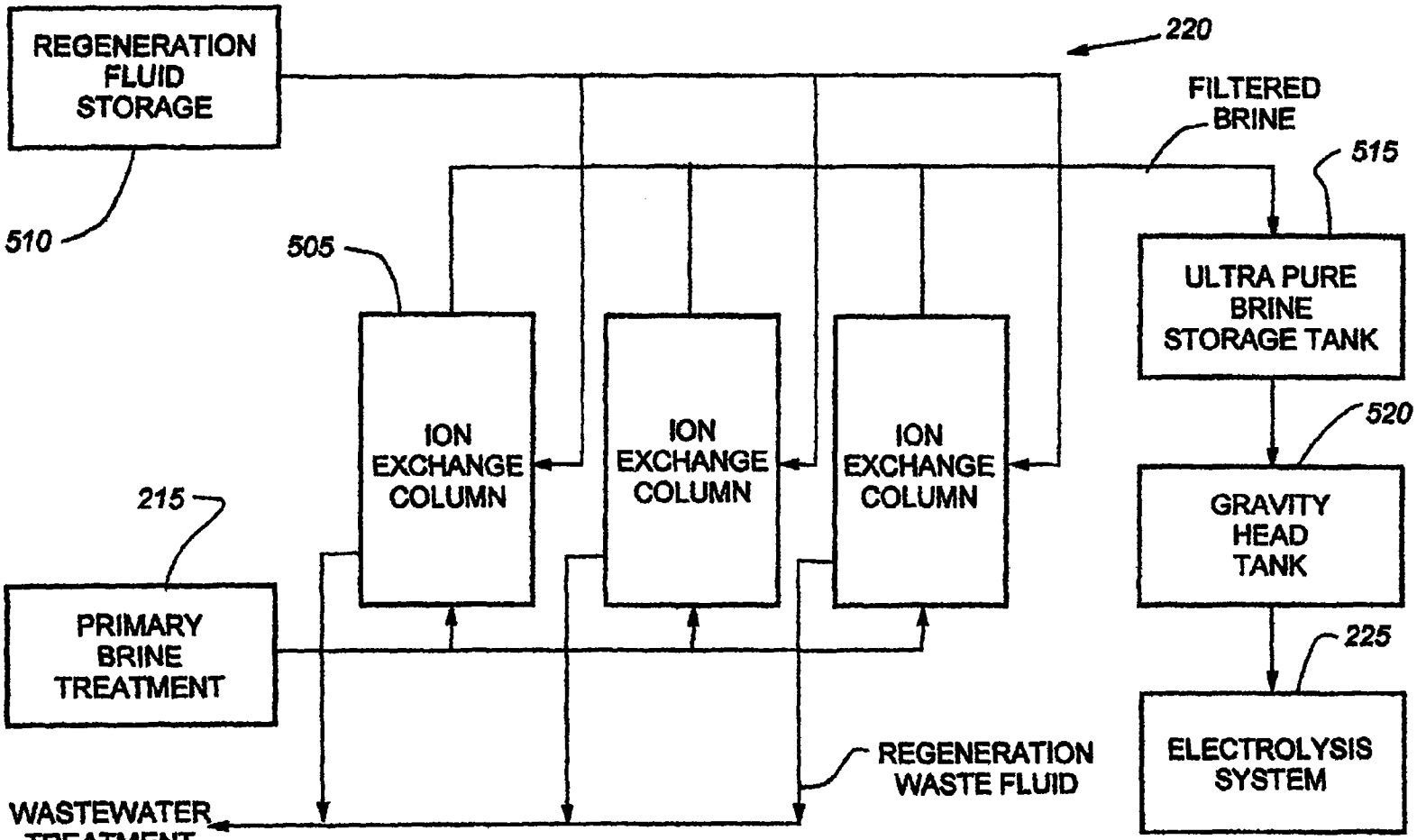
FIG. 5 depicts a schematic view of an example of a secondary brine treatment system that may be used in the chlorine supply and recovery system shown in FIGS. 2A and 2B.

The brine filtered in the primary brine treatment system 215 may be delivered to the secondary brine treatment system 220 via pipes and pumps or other suitable fluid conveyance systems for further filtration and treatment to form an ultra pure brine. The electrolytic membrane process generally requires ultra pure brine, which may be defined as brine containing less than approximately 20 parts per billion total of calcium and magnesium hardness. To achieve this quality, the secondary brine treatment stage or system 220 may include one or more ion exchange columns 505 as shown in FIG. 5. The brine may be passed through a series of the ion exchange columns 505 filled with a chelating resin designed to remove metals of concern, such as calcium, magnesium and strontium. The ion exchange columns 505 may be regenerated on a regular cycle. When one resin bed becomes loaded with the metal ion impurities, it may be taken offline and regenerated with hydrochloric acid followed by caustic soda, which may be stored in regeneration fluid storage tanks 510 or the like. The regeneration waste fluids may be sent to a wastewater treatment plant. Adequate storage capacity for the regeneration wastewaters may be provided to avoid large pH swings in the effluent. Multiple ion exchange beds may be used to provide continuous treatment of the brine during the regeneration of one or more beds.

From the ion exchange beds, the brine may be flowed via pipes or other suitable fluid conveyance systems to an ultra pure brine storage tank 515. The ultra pure brine storage tank 515 may allow for a continuous flow to the cell room of the electrolysis system 225 when one or more ion exchange systems are taken offline for maintenance. The ultra pure brine may flow to a gravity head tank 520, which is an elevated tank that provides for the flow of brine to the cell room in emergencies, such as power outages. The gravity feed tank 520 may protect cells and membranes in the cell room from flow disturbances if the feed pump ceases operation. The pH of the brine may be adjusted with hydrochloric acid from a pH of approximately 8-11 to a pH of approximately 3-4. Acidifying the brine may increase the cell electrical efficiency and may reduce oxygen and chlorate formation in anolyte chambers of the electrolytic cell membranes. The ultra pure brine may then be delivered to the cell room.

Electrolysis System

Figure 6:
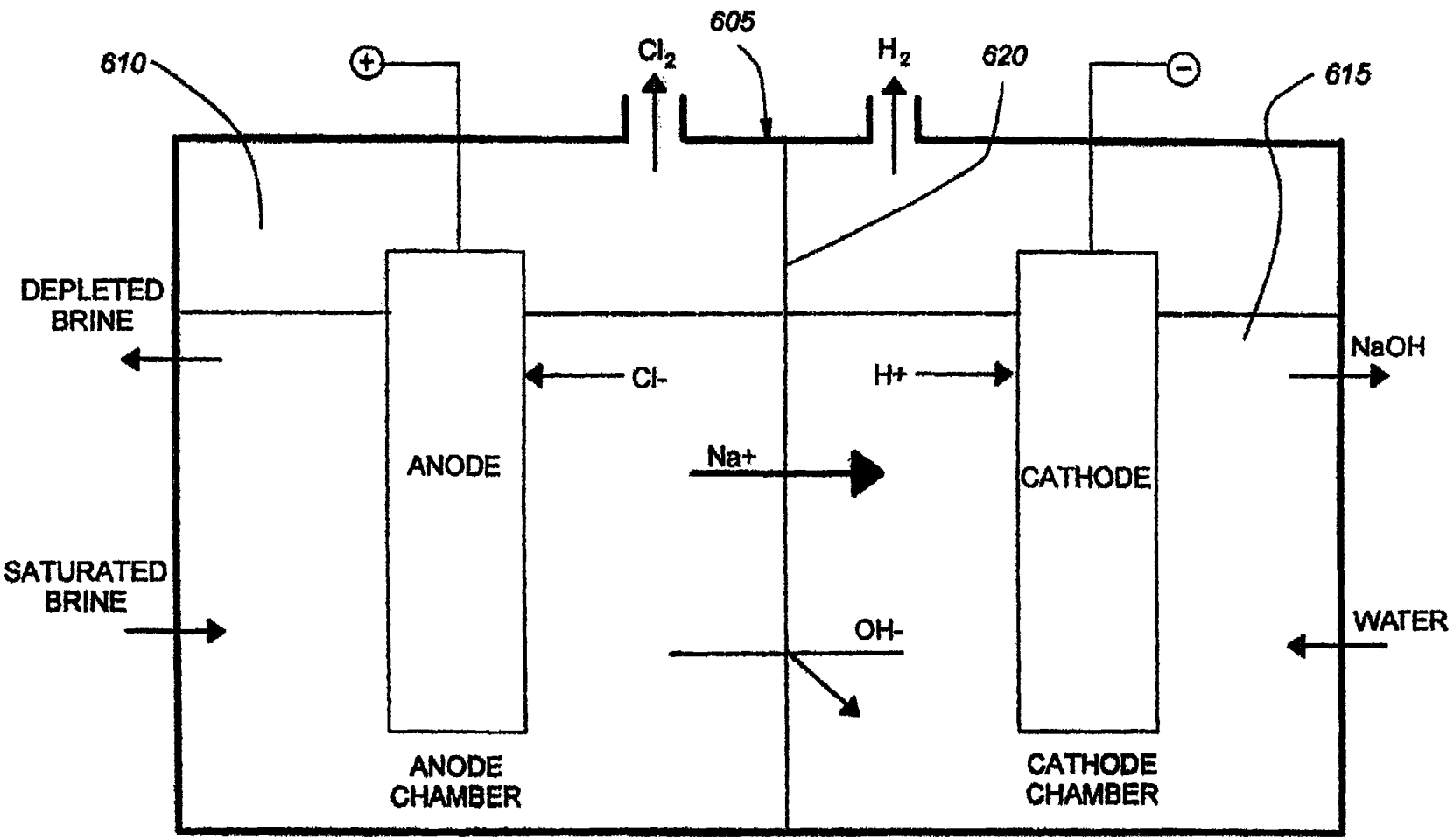
FIG. 6 depicts a schematic view of an example of an electrolytic membrane cell that may be used in the chlorine supply and recovery system shown in FIGS. 2A and 2B.

The ultra pure brine may be fed to the electrolysis system 225, which may house one or more electrolytic membrane cells in a cell room or the like. With reference to FIG. 6, an electrolytic membrane cell 605 may be partitioned into two compartments by an ion exchange membrane: an anode compartment (or anolyte chamber) 610 and a cathode compartment (or catholyte chamber) 615. The ultra pure brine may be fed from the secondary brine treatment system 220 into the anode compartment 610 of each membrane cell 605. A rectified DC current may be applied to the membrane cells 605. As the current passes through a membrane cell 605, the salt molecule may be broken into chlorine and sodium ions. At the anode, the chlorine molecules may be combined to form chlorine gas. At the cathode, the sodium ions may react with water to produce sodium hydroxide (also known as caustic acid) and hydrogen gas. Demineralized water may be added to the cathode chamber 615 to control the caustic soda concentration to approximately 32 percent.

At least four streams may exit an electrolytic membrane cell 605: chlorine gas, hydrogen gas, dilute caustic soda, and depleted brine. The following formulas show the steps of chlorine gas being generated in the anolyte chamber 610. The first step involved the dissolution of the sodium chloride molecule: $NaCl \rightarrow Na^{+}+Cl^{-}$. The second step involves the discharge of chloride ions, $Cl^{-}$, at the anode: $2\ Cl^{-} \rightarrow Cl_2\uparrow+2e^{-}$. The sodium ions may migrate into the cathode compartment 615 through a membrane 620 in the membrane cell 605.

As the salt is removed from the brine by the above reaction, the brine may flow out of the anode compartment 610 to a depleted brine receiver tank. An anolyte recycle may be done to increase cell efficiency. The anolyte recycle may involve recirculating depleted brine from the receiver tank through the electrolyzers. Hydrochloric acid may be added to the recirculated depleted brine to control the pH to control chlorate formation and neutralize back migration of hydroxyl ions. The chlorine gas may exit the top of the anolyte chamber 610 into a chlorine header. The chlorine header may be operated at a slight vacuum.

In the cathode compartment, hydrogen gas and hydroxyl ions may be generated by electrolysis of water by the following process: $2H_20+2e^{-} \rightarrow H_2\uparrow+2OH^{-}$. The hydroxyl ions may combine with the sodium ions, which migrate through the membrane 620, to form caustic soda: $Na^{+}OH^{-} \rightarrow NaOH$.

Water may migrate from the anode compartment 610 into the cathode compartment 615 through the membrane 620 by means of osmotic pressure. This water flow maintains the water balance on the circulating brine solution and keeps the membrane cells 605 operating at peak efficiency. The amount of water passing through the membrane 620 may be insufficient to keep the concentration of the catholyte caustic soda constant. Accordingly, the cathode compartment 615 may be supplied with additional purified water from the demineralized water system.

The membrane 620 may be configured to limit the passage of negatively charged ions. Such a configuration may reduce the potential for the chloride ion in the anolyte chamber 610 to enter the catholyte chamber 615, where it may contaminate the caustic soda with salt. Likewise, the potential for the negative hydroxyl ion to migrate back into the anolyte chamber 610, where it may lower the electrical efficiency of the membrane cell 605, may be reduced.

The membranes 620 may be relatively expensive. Further, operating the system with poor quality brine may result in premature failure of the membranes 620. Yet further, upsetting the water balance or brine strength may cause the two layered membrane 620 to blister. A steady pressure on both the anode and cathode side of the cell may reduce the potential for membrane flapping, which may tear the membrane fabric. A torn membrane 620 may allow hydrogen to mix with chlorine with the potential risk of explosion. Membrane cells 605 may be less tolerant of process upsets than diaphragm cells. Accordingly, attentive care in the plant operations, cell rebuilding, and maintenance may be required for their successful use.

The cathode compartment caustic soda solution may be controlled to approximately 32 percent concentration. A catholyte recycle system may be employed. The catholyte recycle system may involve recirculating the caustic soda solution through the membrane cell 605 and the catholyte receiver. A catholyte storage tank may be placed between the cells and the evaporator to allow for evaporator or cell maintenance without disturbing the remainder of the process.

Hydrogen gas may exit the top of the cathode compartment into a hydrogen header. The hydrogen header may be operated at a slight positive pressure to limit air intrusion into the hydrogen header, where it may form an explosive mixture of hydrogen and oxygen. Safety seals may be provided on the chlorine and hydrogen main headers to protect the electrolyzers from excess pressure. During normal operation, the chlorine gas pressure in the chlorine main header may be controlled by the chlorine gas recycle from the discharge of the chlorine compressor. If the chlorine gas pressure exceeds the level of the water seal, chlorine gas may be vented to a chlorine emergency vent scrubber. The chlorine water seal may also act like a vacuum relief and may suck in air to prevent equipment damage when the chlorine pressure falls below a certain level. No such vacuum seal may be provided on the hydrogen system for safety reasons.

Dechlorination, Desulfonation, and Chlorate Removal Systems

Returning to FIGS. 2A and 2B, since some portion of the salt may not be converted to hydrogen and chlorine in the electrolysis system 225 on a single pass, the depleted brine may be recirculated from the electrolysis system 225 back to the brine treatment system via the brine preparation system 210 for resaturation with salt and treatment. Prior to delivery to the brine preparation system 210, the depleted brine may be treated to remove residual chlorine dissolved in the brine. The residual chlorine may damage the ion exchange resin used in the secondary brine treatment system 220. The first step in this process may involve pumping the depleted brine to the brine dechlorination system, such as a dechlorination tower, for vacuum stripping. The chlorine containing off-gas may be routed through the anolyte receiver to the main chlorine header for chlorine recovery. After vacuum stripping, residual chlorine may remain. The stripped depleted brine stream may be pH adjusted and further treated with sodium sulfite to reduce this residual chlorine.

The depleted brine may be then treated to remove sulfate ions in the sulfate removal system 240. Sulfate may be found as an impurity in the raw salt, and sulfite may be added during dechlorination. The sulfate may continue to increase in concentration in the brine stream, which may adversely impact membrane cell 605 performance. A nanofiltration membrane may used to concentrate a sulfate-rich purge stream, which may be delivered to a wastewater treatment plant. The treated depleted brine may be pumped to the brine preparation system 210 for resaturation with sodium chloride.

Caustic Evaporation System

Dilute caustic that exits the electrolysis system may be fed to a caustic evaporation system 245, so to produce approximately 50 percent caustic soda, may be fed to the primary or secondary brine treatment systems 215, 220 for use in brine treatment, may be fed to the bleach scrubber system to produce sodium hypochlorite in the bleach scrubber system 250, or may be sold. The caustic evaporation system 245 may be a triple effect, counter-current, falling-film caustic evaporator. However, depending upon the size of the plant, simpler evaporators may be used. On multiple effect evaporators, each effect may be provided with a forced circulating system. The catholyte may enter the third effect, flow to the second and then on to the first effect. Steam may be used to heat the first effect and the hot vapor from the first effect heats the second effect. Similarly, the vapor generated in the second effect may be used to heat the third effect. A flash tank may be used after the first effect to reach a final caustic product strength of approximately 50 percent by weight.

Chlorine Gas Cooling/Drying System

The chlorine gas generated in the electrolysis system 225 may be saturated with water. Wet chlorine tends to be very corrosive and special materials of construction may be required for long equipment life. Thus, the chlorine gas from the electrolysis system 225 may be sent to the chlorine gas cooling and drying system 260 to cool and dry the chlorine gas. From the chlorine gas cooling and drying system 260, the chlorine may be fed to the chlorine compression system 270.

The chlorine gas cooling and drying system 260 may include one or more heat exchangers, one or more demisters, and a drying tower. For example, the chlorine gas may be cooled in two heat exchangers and washed with a spray of water. Continuing with the example, the wet chlorine gas may be passed through a wet demister to remove the water mist. Still continuing with the example, the chlorine gas may be dried with concentrated sulfuric acid in a drying tower. The dried gas then may then be passed through a dry demister to remove carry over sulfuric acid droplets.

Chlorine Compression System

The chlorine gas leaving the chlorine cooling/drying system 260 may be delivered to the chlorine compression system 270 to compress the chlorine gas for delivery to a chlorine system. The chlorine compression system 270 may be a skid mounted system that uses a centrifugal or positive displacement compressor and may use a recycle stream back to the suction of the compressor to control compressor pressure and capacity.

Chlorine Liquefaction System

The cool, compressed chlorine gas may be passed through a primary liquefaction condenser to begin the liquefaction process. Refrigerant used in the condenser may be on shell side, and chlorine may be on the tube side. The low temperature of the refrigerant liquefies the chlorine. The liquid chlorine may flow to rail cars. The vent gas from the liquefier may be sent to a vent gas scrubbing tower. The chlorine may be scrubbed with a dilute caustic stream to make sodium hypochlorite.

Hydrogen Handling System

The hydrogen gas generated at the cathode may flow through the dilute caustic to exit the electrolytic membrane cell 605. Because the electrolysis may be carried out at a high temperature, a considerable amount of water may be contained in the hydrogen gas. Similar to the chlorine gas, the hydrogen gas may be cooled and dried in the hydrogen cooling/drying system 265 and compressed in the hydrogen compression system 275. The cooled, dried and compressed hydrogen may be combined with chlorine to form hydrogen chloride, may be used in the polysilicon plant (such as a carrier gas in the deposition reactor), used in other chemical production processes (such as hydrogen peroxide), or as a fuel in a boiler (such as the type that might be used to generate a heating fluid utility for the polysilicon plant) or in thermal oxidizer unit (which could be used to process other waste streams from the polysilicon plant.

Hydrogen Chloride Synthesis/Desorption System

Figure 7:
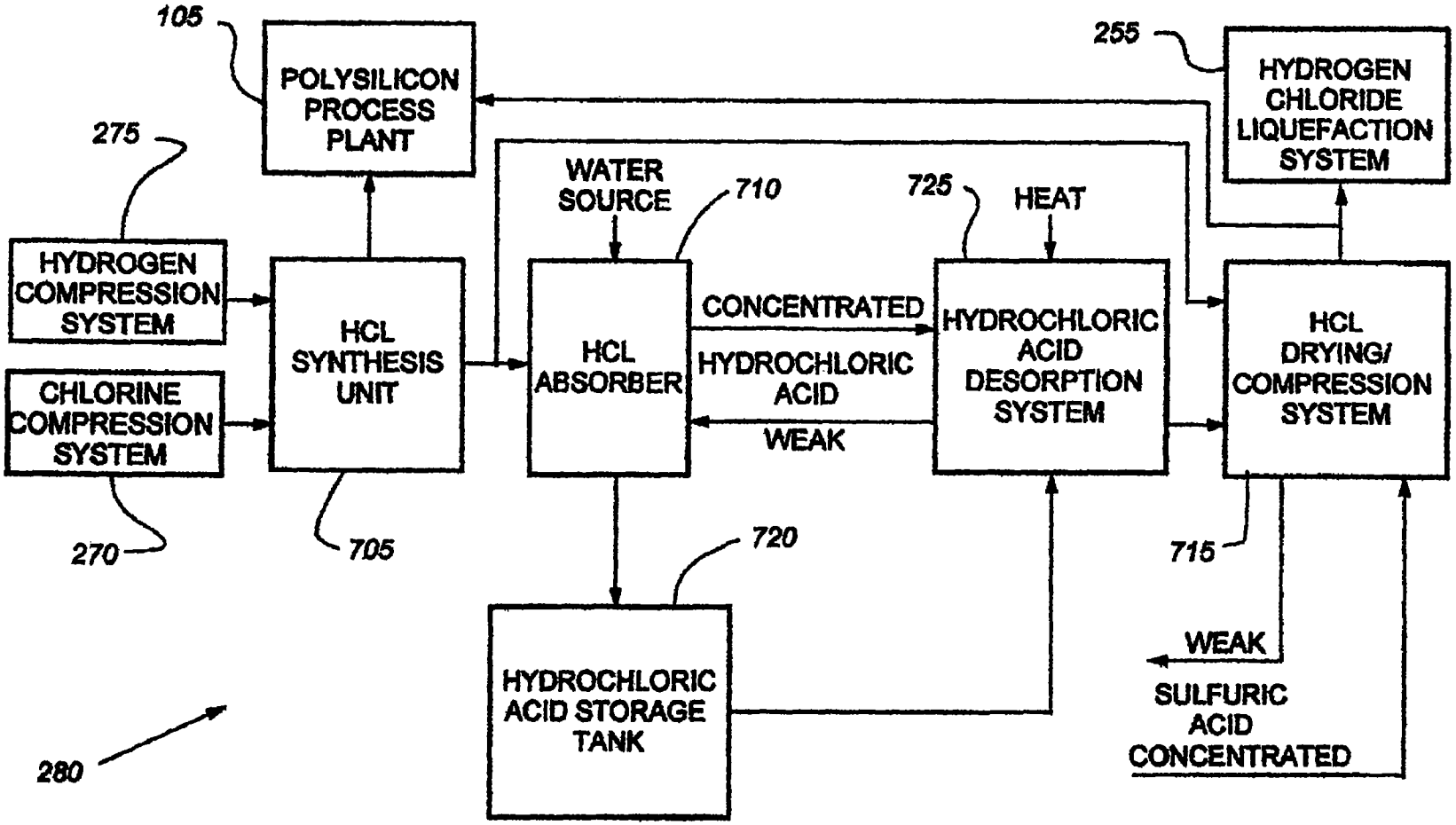
FIG. 7 depicts a schematic view of an example of a hydrogen chloride synthesis/desorption system that may be used in the chlorine supply and recovery system shown in FIGS. 2A and 2B.

Turning to FIG. 7, after drying, cooling and compression, the hydrogen and chlorine generated in the electrolytic membrane cells 605 could be incinerated together in a hydrogen chloride synthesis unit 705 in the hydrogen chloride/desorption system 280 to produce hydrogen chloride gas. This hydrogen chloride gaseous stream could be absorbed into water in a hydrogen chloride absorber 710 to produce hydrochloric acid, be directed to a hydrogen chloride drying/compression system 715 to produce anhydrous hydrogen chloride, or be directly delivered to the polysilicon plant 105. If converted to hydrochloric acid, the hydrochloric acid could be stored in atmospheric storage tanks 720 and then fed to a hydrogen chloride desorption system 725. The wet hydrogen chloride gas from the desorption system 725 could then be processed through the hydrogen chloride drying/compression system 715, which could be concentrated sulfuric acid towers, to reduce the moisture level to less than 10 ppm.

Hydrogen Chloride Liquefaction and Storage System

With continued reference to FIG. 7, after drying in the hydrogen chloride drying/compression system 715, the hydrogen chloride gas may be delivered via pipes or other suitable fluid conveyance systems to the hydrogen chloride liquefaction system 255, which may be a cryogenic column, or delivered directly to the polysilicon plant 105. The cryogenic column may be used to condense the hydrogen chloride gas to a liquefied hydrogen chloride gas. Returning to FIGS. 2A and 2B, the liquefied hydrogen chloride gas could then be stored in the liquefied hydrogen chloride storage system 285, such as a tank or the like, or delivered directly to the polysilicon plant 105. For liquefied hydrogen chloride gas delivered to the polysilicon plant 105 (whether directly or via the liquefied chloride storage tank), the liquefied hydrogen chloride gas could then be processed through the hydrogen chloride vaporizer 290 to return the stream to a gaseous state. Some the hydrogen chloride may be sent to the hydrogen chloride absorber 295, where the hydrogen chloride is contacted with water to produce hydrochloric acid.

Bleach Scrubber System

The bleach scrubber system 250, which may include a vent gas and scrubber system, may be provided to remove chlorine from any vent stream before non-condensable gases are vented to the atmosphere. The vent gas and scrubber system may include a vent gas scrubber tower. During normal operation, some chlorine may flow to the vent gas scrubber tower from the hydrogen chloride liquefaction system 255 for the production of sodium hypochlorite. During start up and shutdown (including emergency shutdown) of the electrolysis system, chlorine gas from the electrolytic membrane cells 605 and chlorine gas drying and compression systems 260, 270 may be routed to the vent gas scrubber. An emergency chlorine vent tower may be provided after the vent scrubber to handle emergency shutdowns, when there are operational problems with the vent scrubber, and for significant gas flow situations.

Sodium Hypochlorite Production

Sodium hypochlorite may be produced in the bleach scrubber system 250. A dilute caustic stream may be recirculated from the electrolysis system 225 to the vent gas scrubber tower in the bleacher scrubber system 250. The sodium hypochlorite may be formed by reaction of chlorine gas with dilute caustic soda. The residual alkalinity in the sodium hypochlorite solution may be controlled by an oxidation reduction potential (ORP) meter. When the ORP reading reaches a pre-determined level, fresh caustic soda may be added.

Flow Example for the Chlorine Supply and Recovery System

Table 1 below shows an example of possible flows of various materials through the chlorine supply and recovery system for a polysilicon plant with a plant capacity of 1000 metric tons per year. In this table, the first column identifies the material, the second column identifies the molecular weight of the material, and the third through fourteenth columns show the flow rate of the material within particular portions of the system shown in FIGS. 2A and 2B. Specific locations where material is flowing at a rate as shown in Table 1 below are identified using the numbers in the table (i.e., 1-12) and the numbers placed in diamonds on FIGS. 2A and 2B. The flow rates and plant capacity are merely illustrative and are not intended to imply or require any specific flows rates for any of the materials within the chlorine supply and recovery system or any specific capacity for the polysilicon plant.

TABLE 1

Sample Flows Rates of Various Materials for a Chlorine Supply and Recovery System

| | | STREAM (kg/hr) | | | | | | | | | | | |
|---|---|---|---|---|---|---|---|---|---|---|---|---|---|
| COMPONENT | MW | 1 | 2 | 3 | 4 | 5 | 6 | 7 | 8 | 9 | 10 | 11 | 12 |
| $H_2$ | 2.0 | — | — | — | — | — | 4.0 | — | 0.2 | 0.2 | — | — | 0.2 |
| HCl | 36.5 | — | — | — | — | — | — | — | 138 | — | 138 | — | — |
| $Cl_2$ | 71.0 | — | — | — | — | — | — | 141 | — | — | — | — | — |

TABLE 1-continued

Sample Flows Rates of Various Materials for a Chlorine Supply and Recovery System

| | | STREAM (kg/hr) | | | | | | | | | | | |
|---|---|---|---|---|---|---|---|---|---|---|---|---|---|
| COMPONENT | MW | 1 | 2 | 3 | 4 | 5 | 6 | 7 | 8 | 9 | 10 | 11 | 12 |
| NaOH | 40.0 | — | — | — | — | — | — | — | — | — | — | 159 | — |
| NaCl | 58.5 | 75 | | 606 | 373 | 160 | — | — | — | — | — | — | — |
| $H_2O$ | 18.0 | | 225 | 1,818 | 1,818 | 480 | — | — | — | — | — | 324 | — |

For the chlorine supply and recovery system described herein, fluids and gasses may be delivered to and from any of the various systems and components by pumps, pipes, gravity feed or any other suitable gas or fluid conveyance devices, systems, and methods. For any fluid storage areas or systems described herein, any suitable device or system, including tanks, basins, vessels and so on, may be used to store any of the solids, fluids or gasses used or generated in the system.

All directional references (e.g., upper, lower, upward, downward, left, right, leftward, rightward, top, bottom, above, below, inner, outer, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and/or in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like.

In methodologies directly or indirectly set forth herein, various steps and operations are described in one possible order of operation, but those skilled in the art will recognize that steps and operations may be rearranged, replaced, or eliminated or have other steps inserted without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A system for supplying chlorine to and recovering chlorine from a polysilicon plant, comprising:

a brine treatment system;

at least one membrane cell operatively associated with the brine treatment system;

a chlorine drying system operatively associated with the at least one membrane cell;

a chlorine compression system operatively associated with the chlorine drying system;

a hydrogen drying system operatively associated with the at least one membrane cell;

a hydrogen compression system operatively associated the hydrogen drying system;

a hydrogen chloride synthesis/desorption system operatively associated with the chlorine compression system and the hydrogen compression system;

a hydrogen chloride liquefaction system operatively associated with the hydrogen chloride synthesis/desorption system;

a liquefied hydrogen chloride storage system operatively associated with the hydrogen chloride liquefaction system;

a hydrogen chloride vaporizer operatively associated at least one of the liquefied hydrogen chloride storage system and the hydrogen chloride liquefaction system; and the hydrogen chloride vaporizer in fluid communication with a reactor feed delivery system located within a polysilicon plant.

2. The system of claim 1, wherein the brine treatment system comprises a first brine treatment system in fluid communication with a second brine treatment system, and the second brine treatment system operatively associated with the at least one membrane cell.

3. The system of claim 1, further comprising a brine recirculation system operatively associated with the at least one membrane cell.

4. The system of claim 3, wherein the brine recirculation system comprises:

a chlorate removal system;

a brine dechlorination system operatively associated with the chlorate removal system; and a sulfate removal system operatively associated with the brine dechlorination system.

5. The system of claim 1, wherein the at least one membrane cell comprises an electrolytic membrane cell.

6. The system of claim 1, further comprising a brine preparation system operatively associated with the brine treatment system.

7. The system of claim 1, wherein the hydrogen chloride synthesis/desorption system comprises a hydrogen chloride synthesis unit operatively associated with the hydrogen compression system and operatively associated with the chlorine compression system.

8. The system of claim 7, wherein the hydrogen chloride synthesis/desorption system further comprises a hydrogen chloride absorber operatively associated with the hydrogen chloride synthesis unit.

9. The system of claim 8, wherein the hydrogen chloride synthesis/desorption system further comprises a hydrochloric acid desorption system operatively associated with the hydrogen chloride absorber.

10. The system of claim 9, wherein the hydrogen chloride synthesis/desorption system further comprises a hydrogen chloride drying/compression system operatively associated with at least one of the hydrogen chloride synthesis unit and the hydrochloric acid desorption system.

11. The system of claim 9, wherein the hydrogen chloride synthesis/desorption system further comprises a hydrochloric acid storage tank operatively associated with the hydrochloric absorber and operatively associated with the hydrochloric acid desorption system.

12. The system of claim 1, further comprising a waste conversion and filtration system operatively associated with the brine treatment system.

13. The system of claim 12, further comprising a brine preparation system operatively associated with the brine treatment system, and the waste conversion and filtration system is operatively associated with the brine treatment system via the brine preparation system.

14. The system of claim 12, wherein the waste conversion and filtration system comprises:

a neutralization system;

a first filtration system operatively associated with the neutralization system;

a brine concentration system operatively associated with the first filtration system;

a clarifier operatively associated with the brine concentration system; and a second filtration system operatively associated with the clarifier.

15. The system of claim 14, wherein the brine concentration system comprises a multiple effect evaporator.

* * * * *